US009599430B1

(12) United States Patent
Geissele

(10) Patent No.: US 9,599,430 B1
(45) Date of Patent: Mar. 21, 2017

(54) FIREARM HANDGUARD

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 14/860,933

(22) Filed: Sep. 22, 2015

Related U.S. Application Data

(63) Continuation-in-part of application No. 29/537,369, filed on Aug. 25, 2015.

(51) Int. Cl.
*F41C 23/00* (2006.01)
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS 7,770,317 B1 * 8/2010 Tankersley ..... F41C 23/16 42/71.01
D641,450 S 7/2011 Ding
D709,582 S 7/2014 Geissele
8,819,980 B2 9/2014 Geissele
8,904,691 B1 * 12/2014 Kincel ..... F41C 23/16 42/71.01
9,032,658 B2 5/2015 Geissele
D733,246 S 6/2015 Wells
D747,428 S 1/2016 Chen
D752,171 S 3/2016 Chen
D754,274 S 4/2016 Geissele
D757,201 S 5/2016 Meier
9,389,043 B1 * 7/2016 Zhang ..... F41C 23/16
2006/0236582 A1 * 10/2006 Lewis ..... F41A 3/26 42/73
2011/0247254 A1 * 10/2011 Barnes ..... F41A 21/48 42/71.01
2013/0205637 A1 * 8/2013 Patel ..... F41A 3/66 42/75.02
2014/0026459 A1 1/2014 Yan
2014/0373419 A1 * 12/2014 Leclair ..... F41C 23/16 42/71.01
2015/0316347 A1 * 11/2015 Shea ..... F41C 23/16 42/75.02

OTHER PUBLICATIONS

Photographs of Heckler Koch handguard (publicly available before Aug. 25, 2015).

* cited by examiner

*Primary Examiner* — Gabriel Klein
(74) *Attorney, Agent, or Firm* — Merchant & Gould, PC

(57) ABSTRACT

A free-floating firearm handguard having vertically offset mounting fasteners.

16 Claims, 7 Drawing Sheets

FIREARM HANDGUARD

CROSS-REFERENCE TO RELATED APPLICATIONS

This application is a continuation-in-part of U.S. patent application Ser. No. 29/537,369 filed Aug. 25, 2015 titled FIREARM RAIL, the disclosure of which is hereby incorporated by reference in its entirety.

BACKGROUND

Firearm handguards are designed to protect the shooter from being burned due to contact with the hot barrel of a firearm. Handguards can also be used to facilitate the connection of weapon accessories (e.g., optics, laser, night vision, foregrips, bipods, tactical lights, etc.) to the firearm.

There is a need to facilitate the coupling of a handguard to a firearm.

SUMMARY

In general terms, this disclosure is related to a firearm handguard and a firearm having a firearm handguard.

In one aspect, a handguard for a firearm comprises an elongate member comprising a bore defining a longitudinal axis of the handguard; a firearm coupling portion; a first coupler receiver disposed in the firearm coupling portion; and a second coupler receiver disposed in the firearm coupling portion, the first and second coupler receivers being configured to receive fasteners to secure the handguard to the firearm, and the second coupler receiver being closer to the longitudinal axis of the handguard than the first coupler receiver.

In another aspect, a firearm comprises: a receiver; a barrel nut; and a free-floating handguard coupled to the receiver with the barrel nut, the handguard comprising a top, a bottom, a firearm coupling portion, a first coupler receiver disposed in a first tier of the firearm coupling portion and a second coupler receiver disposed in a second tier of the firearm coupling portion, the first tier extending lower than the second tier, the first and second coupler receivers being configured to receive fasteners to secure the handguard to the firearm, and the second coupler receiver being higher than the first coupler receiver.

In a further aspect, a firearm comprises: a receiver; a barrel nut; and a free-floating handguard coupled to the receiver with the barrel nut, the handguard comprising a top, a bottom, a firearm coupling portion, a first hole disposed in a first tier of the firearm coupling portion for receiving a first bolt and a second hole disposed in a second tier of the firearm coupling portion for receiving a second bolt, the first tier extending lower than the second tier; wherein the first bolt engages a groove in a bottom interior surface of the handguard; wherein the second bolt engages a groove in the barrel nut, the barrel nut being disposed in a longitudinal bore of the handguard; and wherein the first bolt is lower than the second bolt.

DETAILED DESCRIPTION

Figure 1:
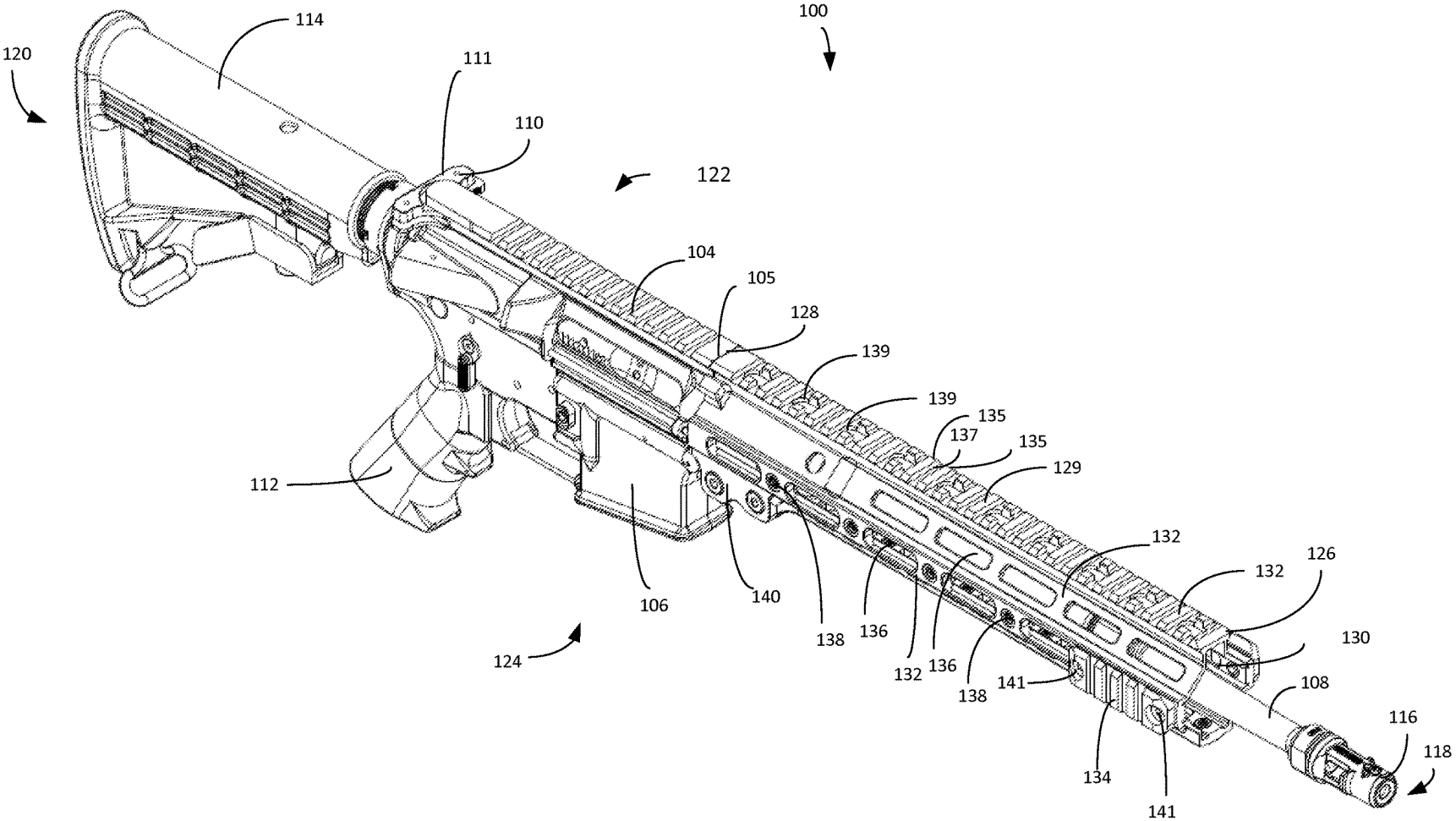
FIG. 1 is a perspective view of an example firearm including an example handguard in accordance with the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of an example firearm 100 including an example handguard 102 in accordance with the present disclosure.

With reference to FIG. 1, the firearm 100 includes the handguard 102, an upper receiver 104 having a front end 105, a lower receiver 106, a barrel 108, optionally a charging handle 110, a grip 112, optionally a stock 114, and optionally a muzzle brake 116. The firearm 100 is defined by a front 118, a back 120, a top 122 and a bottom 124. Throughout this disclosure, references to orientation (e.g., front(ward), rear(ward), in front, behind, above, below, high, low, back, top, bottom, under, underside, etc.) of structural components shall be defined by that component's positioning in FIG. 1 relative to, as applicable, the front 118, the back 120, the top 122, and the bottom 124 of the firearm 100, regardless of how the firearm 100 may be held and regardless of how that component (e.g., the handguard 102) may be situated on its own (i.e., separated from the firearm 100).

The handguard 102 includes a front end 126, a back end 128, an elongate member 129 disposed between the front end 126 and the back end 128, a longitudinal bore 130 within the elongate member 129 and extending from the back end 128 to the front end 126, an outer surface 131 having a plurality of sides 132, one or more mounting platforms 134, a plurality of apertures 136, a plurality of fastener receivers 138, and a firearm coupling portion 140.

In some examples, the firearm 100 is configured to have a plurality of operating modes. Examples of operating modes include a normal mode and a semi-automatic mode. In normal mode, the firearm 100 discharges a round of ammunition following activation of a trigger mechanism. To reset the trigger mechanism to fire another round of ammunition, the user manually actuates the charging handle 110. In semi-automatic mode, the trigger mechanism automatically resets after firing each round of ammunition without needing to actuate the charging handle 110, and without the need to include a charging handle 110 on the firearm 100.

The firearm 100 can be of a variety of types. Examples of a firearm include handguns, rifles, shotguns, carbines, and personal defense weapons. In at least one embodiment, the firearm 100 is implemented as an M4 carbine or a variant of an M4 carbine.

The upper receiver 104 is configured to house a bolt assembly. In a typical firearm 100, the bolt assembly is slidably disposed in the upper receiver 104 for axially reciprocating recoil movement therein during the firing cycle sequence of the firearm 100.

The lower receiver 106 houses a trigger mechanism configured to initiate the firing cycle sequence of the firearm 100 when a predetermined amount of force is applied to a trigger. A magazine containing one or more rounds of ammunition can be coupled to the lower receiver 106 for depositing rounds of ammunition in the chamber of the upper receiver 104 for each sequential firing cycle of the firearm 100.

The barrel 108 is mated to the upper receiver 104, and the upper receiver 104 is in open communication with the barrel 108. During a firing cycle a firing pin carried by a bolt in the bolt mechanism is thrust forward to contact and discharge a cartridge loaded in a chamber in the upper receiver 104. A projectile (e.g., a bullet) from the cartridge then travels through the barrel 108 and exits the firearm 100 at the front end (i.e., the muzzle) of the barrel 108 towards a target. The spent cartridge is ejected from the upper receiver 104 either automatically, or manually upon actuation of the charging handle 110.

The charging handle 110 is slidably disposed within the upper receiver 104. A front portion of the charging handle 110 engages the bolt assembly within the upper receiver 104. A rear portion of the charging handle 110 is exterior to the upper receiver 104 and includes a hand engagement portion 111 for actuating the charging handle 110.

The grip 112 provides a point of support for the shooter of the firearm and can be held by the shooter's hand, including when operating a trigger mechanism. The grip 112 assists the shooter in stabilizing the firearm 100 during firing and manipulation of the firearm 100. In some embodiments, the grip 112 is mounted to the lower receiver 106.

The stock 114 can be of a variety of shapes and configurations. The stock 114 is disposed behind the upper receiver 104. During typical operation of the firearm 100, the stock 114 rests against the body of the shooter, channeling recoil energy generated from exploding gases during the firing cycle to the body of the shooter. Optionally, the stock 114 contains an energy absorbing mechanism, such as a buffer tube.

The muzzle brake 118 is coupled to the front end of the barrel 108 and functions to redirect gases exiting the front of the barrel 108 during a firing cycle to reduce recoil, "kick," and/or noise associated with firing the firearm 100.

The handguard 102 (also known as a rail) surrounds at least a portion of the barrel 108 and functions as a support for the user's front hand when firing the firearm 100. The handguard 102 may also act to protect the user's hand from getting burned by the barrel 108, which can become extremely hot when the firearm 100 is being fired. The handguard 102 may also be used for mounting accessories (e.g., a fore-grip, a flashlight, a laser, optic equipment).

The example elongate member 129 has a unitary construction, and can be constructed from an extruded aluminum or other metal that is subsequently machined. The handguard 102 is of the free-floating type. In other words, transfer of the forces applied to the handguard via the shooter's hand or, e.g., a bipod, to the barrel are minimized. This free-floating construction allows for more accurate shooting. It should be appreciated that many other alternative configurations are also possible (e.g., multiple piece construction, non-free floating constructions, non-metal constructions, alternative metal constructions, etc.).

A rear portion of the handguard 102 (i.e., the firearm coupling portion 140) is mounted to the barrel 108 via a barrel nut such that the back end 128 of the handguard 102 abuts the front end 105 of the upper receiver 104. The portion of the handguard 102 that is forward of the barrel nut is cantilevered off the barrel nut.

The sides 132 (which can include, top, bottom, right and left sides, as well as one or more sides between adjacent pairs of the top, bottom, right, and left sides) provide surfaces that the user can ergonomically grip. Alternatively, the outside surface can be rounded (e.g., cylindrical) or portions thereof can be rounded to provide an ergonomic grip.

The apertures 136 are disposed in one or more of the sides 132 of the elongate member 129 of the handguard 102. The apertures 136 reduce the weight of the handguard 102 and also serve as heat vents, allowing heat radiating from the barrel 108 as a result of shooting the firearm 100 to escape, thereby minimizing excessive heat build-up between the handguard 102 and the barrel 108. In addition, the apertures 136 can be used to receive components (such as lugs) of accessories to facilitate (e.g., by aligning the accessory with the appropriate fastener receivers 138) securing of the accessories to the handguard 102. The number, size, shape, and distribution of the apertures 136 can be adjusted or customized for particular firearms, accessories, or other requirements (e.g., aesthetics), and the same handguard can include apertures of different sizes and/or shapes.

The mounting platforms 134 are disposed on one or more of the sides 132. The mounting platforms 134 facilitate mounting of accessories (e.g., a fore-grip, a flashlight, a laser, optic equipment), to the firearm 100. The mounting platforms 134 can be an integral part of the elongate member 129. Alternatively, the mounting platforms 134 can be modular, i.e., attachable and removable to the elongate member 129, e.g., with fasteners 141 (e.g., screws, bolts, pins) that mate with the fastener receivers 138. In this example, the mounting platforms 134 include mounting ribs 135 that alternate with grooves 137 as well as fastener holes 139. The mounting ribs 135 with their corresponding grooves 137 provide an engagement surface for mounting firearm accessories having corresponding ribs and grooves that engage the grooves 137 and mounting ribs 135, respectively. In one example, the mounting ribs 135 are standard dimension such as a "Picatinny" style mounting platform, also known as MIL-STD-1913.

The fastener holes 139 and the fastener receivers 138 are configured to receive fasteners for securing one or more accessories to the handguard 102. In some examples, the fastener holes 139 and/or the fastener receivers 138 are threaded in order to receive correspondingly threaded screw fasteners. The firearm coupling portion 140 will be discussed in greater detail below.

Figure 2:
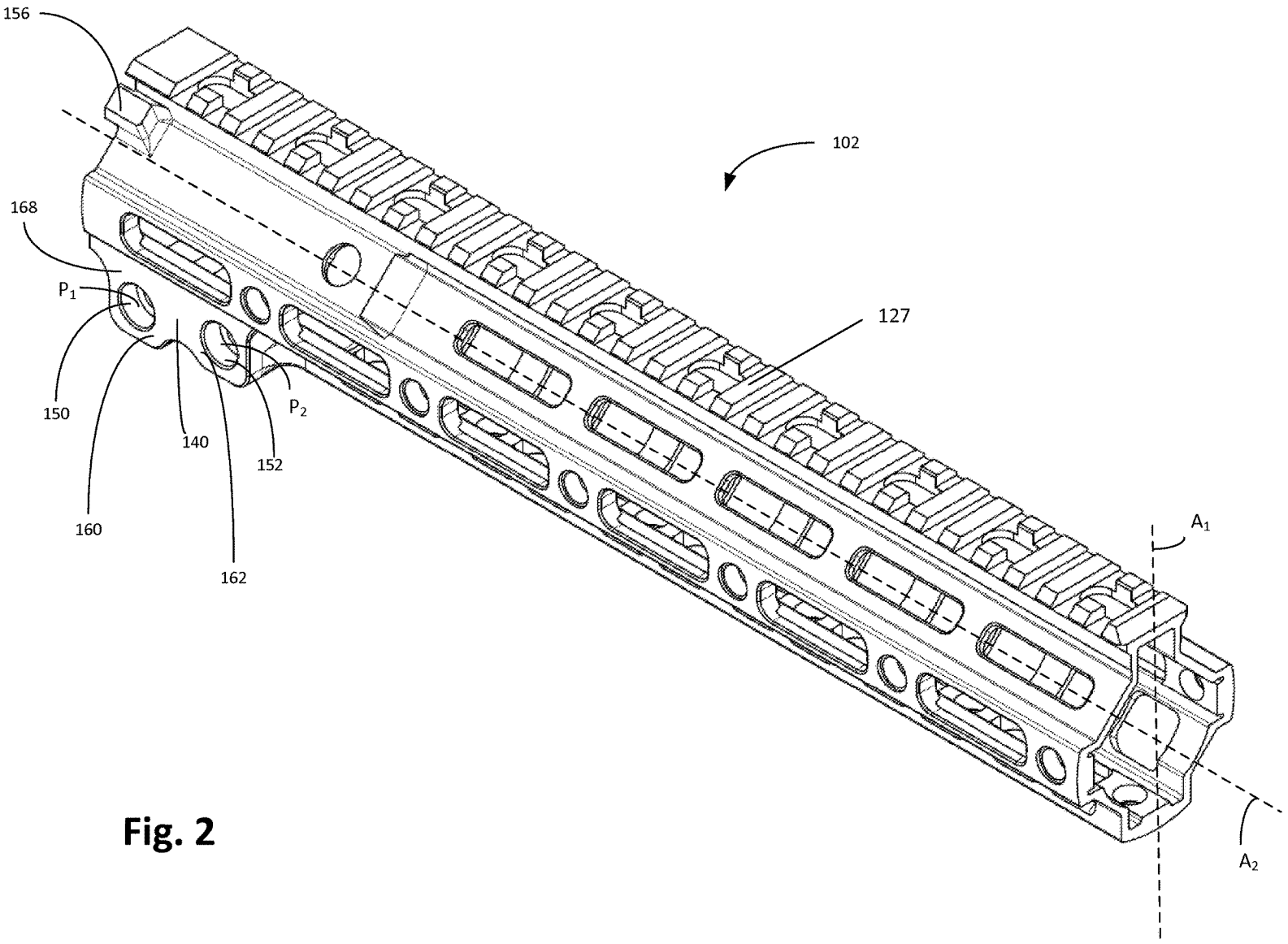
FIG. 2 is a perspective view of the handguard of FIG. 1 in an unassembled configuration.
Figure 3:
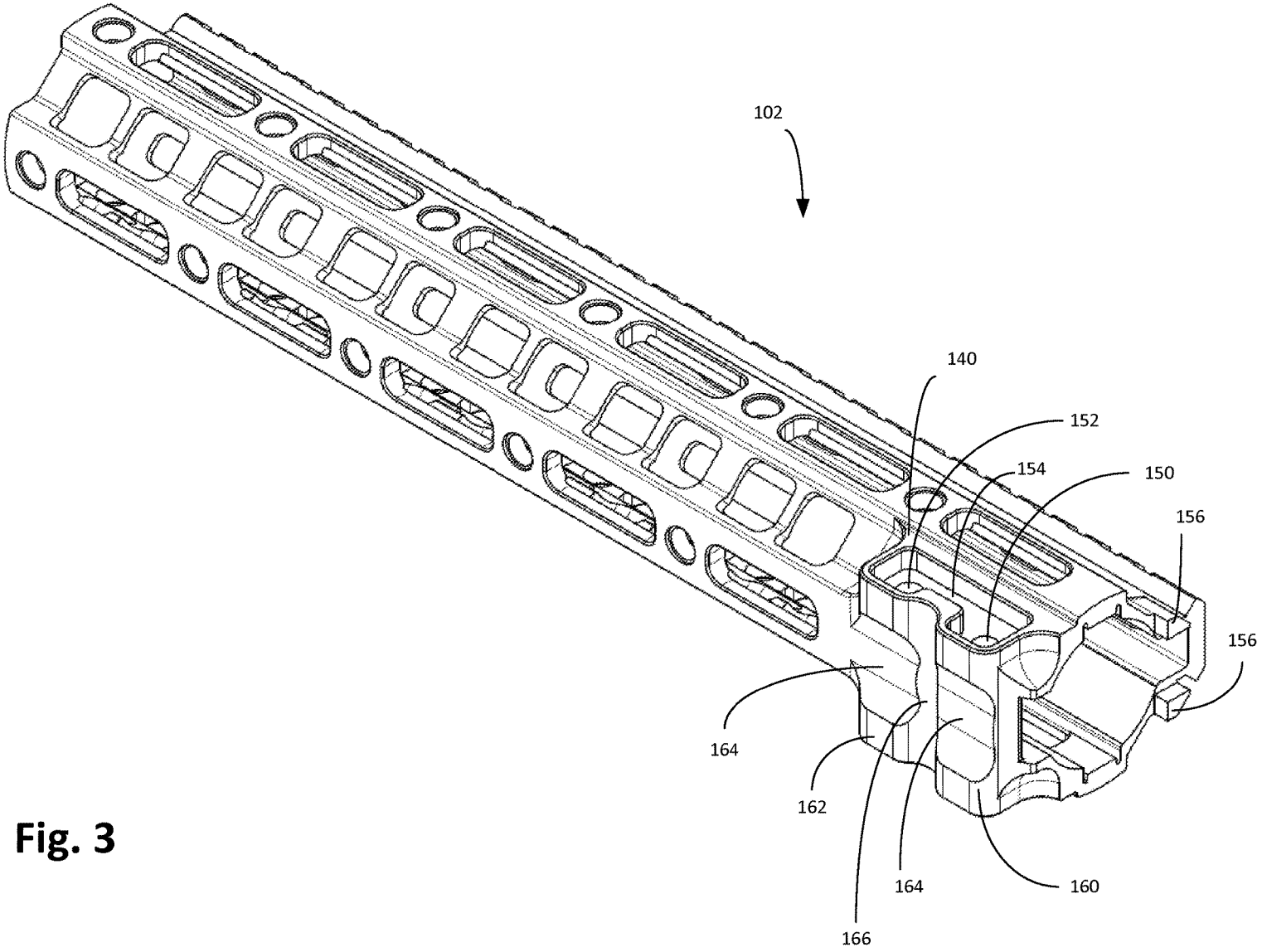
FIG. 3 is a further perspective view of the handguard of FIG. 1 in an unassembled configuration.

FIG. 2 is a perspective view of the handguard 102 of FIG. 1 in an unassembled configuration. FIG. 3 is a further perspective view of the handguard 102 of FIG. 1 in an unassembled configuration. With reference to FIGS. 2-3, the handguard 102 includes the front end 126, the back end 128, the elongate member 129, the longitudinal bore 130, the outer surface 131 having the plurality of sides 132, the one or more mounting platforms 134, the plurality of apertures 136, the plurality of fastener receivers 138, and the firearm coupling portion 140 as discussed above. In addition, the firearm coupling portion 140 includes a first coupler receiver 150, a second coupler receiver 152, a recess 154, and stabilizers 156.

The stabilizers 156 project rearwards from the back end 128 of the handguard 102. When the handguard 102 is secured to an upper receiver (e.g., the upper receiver 104 of FIG. 1), the stabilizers engage the outer surface of the upper receiver on either side of the top 122 (FIG. 1) of the firearm 100 (FIG. 1), thereby stabilizing the handguard 102 by minimizing rotational movement about its longitudinal axis relative to the upper receiver 104.

The firearm coupling portion 140 is disposed toward the back end 128 of the handguard 102 and extends downward from the elongate member 129 such that the bottom of the firearm coupling portion 140 is lower than the bottom side 158 (FIG. 3). In this example, the firearm coupling portion 140 includes a first tier 160 and a second tier 162, the first tier 160 extending below the second tier 162. Optionally, depressions 164 (FIG. 3) in one or both of the bottom surfaces of the first tier 160 and the second tier 162, and/or a groove 166 (FIG. 3) disposed between the first tier 160 and the second tier 162 facilitate positioning and stabilizing the firearm 100 (FIG. 1) for shooting (e.g., by resting the depressions 164 and/or the groove 166 on corresponding components of a bipod for target practice or a shooting competition). The depressions 164 and the groove 166 can be customized in number, size, shape, depth, and/or placement for aesthetics and/or in accordance with the intended apparatus (e.g., a bipod) to which they are to rest upon/be coupled to.

The first coupler receiver 150 includes a hole extending from the recess 154 through the first tier 160 into the longitudinal bore 130 (see FIG. 3), and a correspondingly aligned hole that extends from the longitudinal bore 130 through the opposing side 168 of the firearm on the opposing side of first tier 160 (see FIG. 2). In some examples, within the longitudinal bore 130 the first coupler receiver 150 also includes a groove (discussed further below) extending laterally between the aligned holes in the first tier 160.

The second coupler receiver 152 includes a hole extending from the recess 154 through the second tier 162 into the longitudinal bore 130 (see FIG. 3), and a correspondingly aligned hole that extends from the longitudinal bore 130 through the opposing side 168 of the firearm on the opposing side of second tier 162 (see FIG. 2).

The first coupler receiver 150 and the second coupler receiver 152 are configured to receive coupling mechanisms (e.g., bolts, screws, pins). In some examples, the coupling mechanisms extend through the entirety of the first coupler receiver 150 and the second coupler receiver 152 (i.e., laterally across the width of the firearm coupling portion 140) and reversibly secured in place (e.g., with a nut). The first coupler receiver 150 and the second coupler receiver 152 are vertically offset from each other, the first coupler receiver 150 being lower than the second coupler receiver. That is, a center point $P_1$ of the first coupler receiver 150 is offset from a center point $P_2$ of the second coupler receiver 152 along a vertical axis $A_1$, $A_1$ being perpendicular to the longitudinal axis $A_2$ of the handguard 102, as shown in FIG. 2. In the example shown, the second coupler receiver 152 is closer to the longitudinal axis $A_2$ and closer to the top 127 of the handguard 102, than the first coupler receiver 150. The second coupler receiver 152 is configured to receive a coupling mechanism that engages a bolt nut (discussed below) to thereby secure the handguard 102 to the rest of the firearm 100 (FIG. 1), preventing detachment of the handguard 102 from the firearm 100 (FIG. 1).

The recess 154 is configured to house one or more nuts (e.g., a press nut) to secure the first coupler receiver 150 and the second coupler receiver 152 in place as just described.

Figure 4:
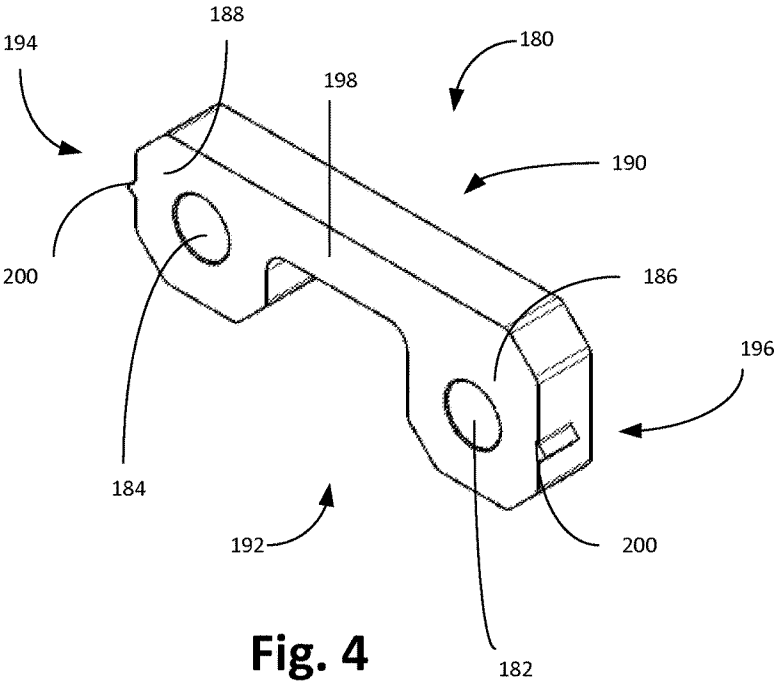
FIG. 4 is a perspective view of an example press nut for use with the example handguard of FIG. 1.

FIG. 4 is a perspective view of an example press nut 180 for use with the example handguard 102 of FIG. 1. The press nut 180 is configured to be received in the recess 154 (FIG. 3) of a handguard 102 (FIG. 3).

The press nut 180 includes a first through hole 182 configured to be aligned with the first coupler receiver 150 (FIG. 3), and a second through hole 184 configured to be aligned with the second coupler receiver 152 (FIG. 3) when the press nut 180 is placed in the recess 154 (FIG. 3). The press nut 180 includes a top 190, a bottom 192, a front 194, and a back 196.

The first through hole 182 is disposed in a first nut portion 186, and the second through hole 184 is disposed in a second nut portion 188, the first nut portion 186 extending lower (i.e., towards the bottom 192) than, the second nut portion 188. The first through hole 182 is vertically offset compared with, and disposed lower than, the second through hole 184. A connecting element 198 connects the first nut portion 186 with the second nut portion 188. The connecting element 198 can facilitate in the distribution of torque or other forces experienced by the handguard 102 (FIG. 3) relative to e.g., a barrel nut, as discussed further below.

Optionally, the press nut 180 includes one or more aligning elements 200 extending towards the front 194 and/or the back 196 that can facilitate proper placement of the press nut 180 within the recess 154 and/or contact a surface of the recess 154 for improved retention (e.g., frictional retention) of the press nut 180 by the recess 154 prior to securing the press nut 180 to a barrel nut.

Figure 5:
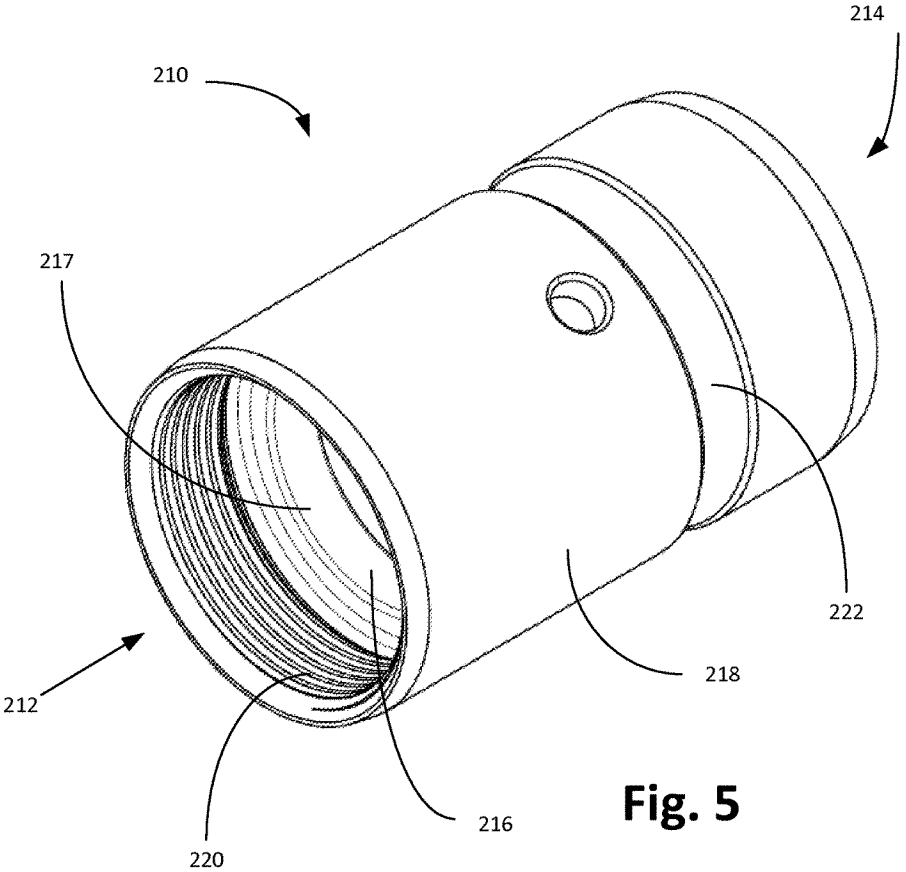
FIG. 5 is a perspective view of an example barrel nut for use with the example firearm and the example handguard of FIG. 1.

FIG. 5 is a perspective view of an example barrel nut 210 for use with the example firearm 100 and the example handguard 102 of FIG. 1. The barrel nut 210 includes a back 212, a front 214, an interior surface 216, an interior bore 217, an exterior surface 218, screw threads 220 and a groove 222.

The barrel nut 210 is generally tubular, open at the front 214 and the back 212 with the interior bore 217 therebetween to allow open communication between the barrel (e.g., the barrel 108 of FIG. 1), and the upper receiver (e.g., the upper receiver 104) of a firearm. In an assembled configuration, a rear portion of the barrel extends through the interior bore 217 and the barrel is held in place by the coupling of the barrel nut 210 to the upper receiver.

The screw threads 220 are disposed on the interior surface 216 of the barrel nut 210 towards the back 212 of the barrel nut 210, and are configured to mate with corresponding threading in an upper receiver (e.g., the upper receiver 104 of FIG. 1), to thereby secure the barrel nut 210 to the upper receiver.

The groove 222 follows the tubular configuration of the barrel nut 210 and is disposed in the exterior surface 218. The groove 222 is positioned to align with the second coupler receiver 152 (FIG. 3), and configured to receive a coupler (e.g., a bolt), as discussed further below.

Figure 6:
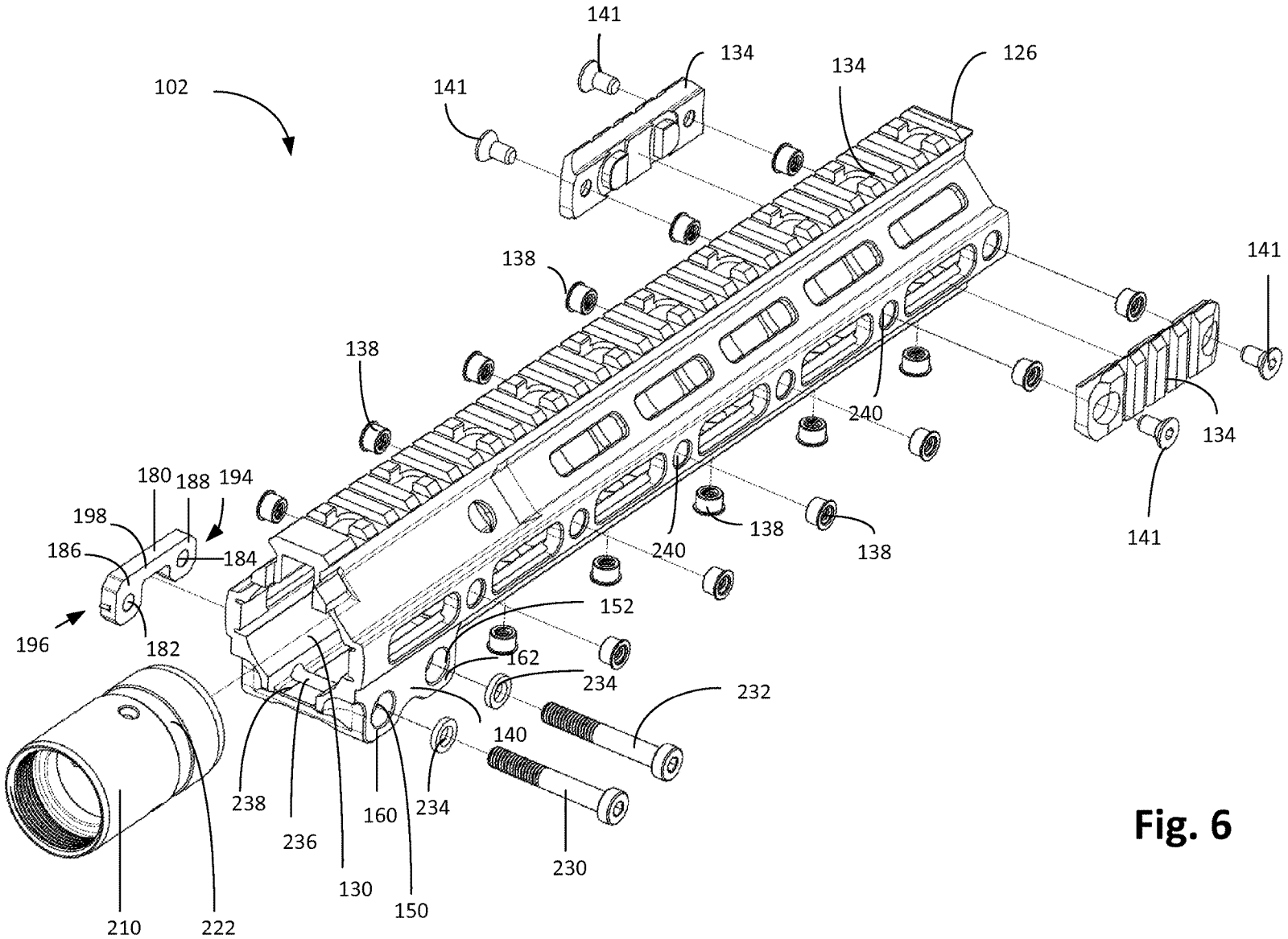
FIG. 6 is an exploded, assembly view of the handguard of FIG. 1, including the barrel nut of FIG. 5.

FIG. 6 is an exploded, assembly view of the handguard 102 of FIG. 1, including the barrel nut 210 of FIG. 5. The handguard 102 includes the front end 126, the back end 128, the longitudinal bore 130, the mounting platforms 134, the fastener receivers 138, the firearm coupling portion 140, the fasteners 141, the first coupler receiver 150, the second coupler receiver 152, the first tier 160, the second tier 162, the press nut 180 having the first through hole 182, the second through hole 184, the first nut portion 186, the second nut portion 188, the front 194, the back 196, and the connecting element 198 as discussed above. In addition, the barrel nut 210 includes the groove 222 as discussed above.

Figure 7:
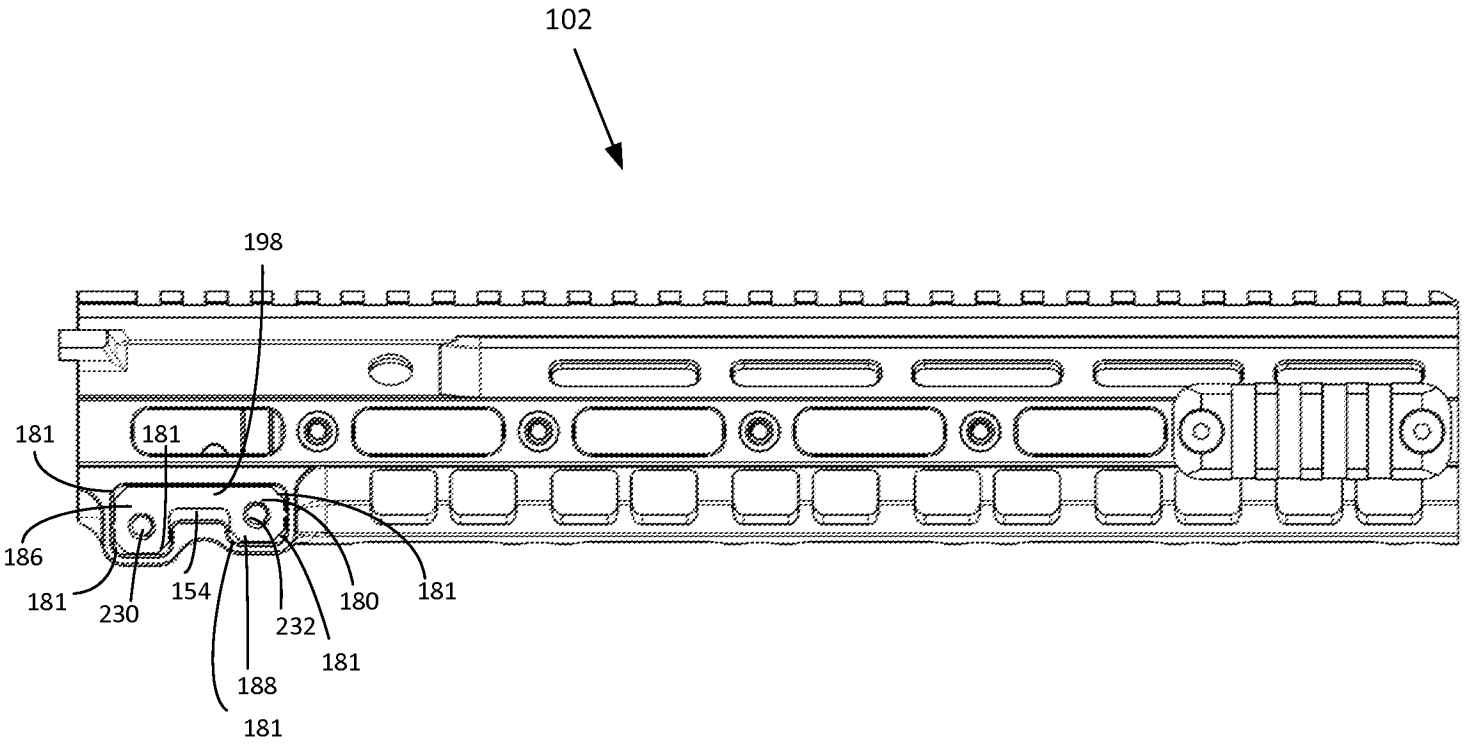
FIG. 7 is a left side view of the handguard of FIG. 1.

Also, in this example, the handguard 102 includes a first bolt 230, a second bolt 232, washers 234, a first bolt groove 236 disposed in a bottom interior surface 238 of the handguard 102, and fastener receiver openings 240. FIG. 7 is a left side view of the handguard 102 of FIG. 1, including the recess 154, the press nut 180, the first nut portion 186, the second nut portion 188, the connecting element 198, the first bolt 230 and the second bolt 232. Optionally, the press nut 180 is configured (e.g., with beveled or rounded corners) such that there are gaps 181 between points of contact between the press nut 180 and the recess 154, to facilitate insertion and extraction of the press nut 180 into/from the recess 154.

Each of the fastener receivers 138 is optionally removable from the handguard 102, and removably insertable and securable into the fastener receiver openings 240 disposed along the sides of the handguard 102.

To secure the handguard 102 to the barrel nut 210, the handguard 102 is positioned such that the barrel nut 210 is disposed in the longitudinal bore 130 and such that a portion of the groove 222 aligns with the second coupler receiver 152. The second bolt 232 is optionally passed through a washer 234, into the second coupler receiver 152, into the groove 222, and screwed into the second through hole 184 of the press nut 180, the press nut 180 being disposed within the recess 154, as shown in FIGS. 6-7. Optionally, a bottom portion of the first bolt 230 is disposed in a first bolt groove 236 in the bottom interior surface of the handguard 102. The first bolt 230 is optionally passed through a washer 234, into the first coupler receiver 150, along the first bolt groove 236, and screwed into the first through hole 182 of the press nut 180, as shown in FIGS. 6-7.

The inside surface of the handguard 102 is configured to clamp onto the barrel nut 210 when the first bolt 230 and the second bolt 232 are tightened. By passing the second bolt 232 through the groove 222 in the barrel nut 210, the handguard is prevented from moving axially relative to the barrel nut 210. In the depicted embodiment, the barrel nut 210 is elongated (e.g., greater than 1 inch) to account for the cantilever load applied thereto given the free-floated construction of the handguard as described above.

Due to the vertical offset between the first bolt 230 and the second bolt 232 (see FIG. 9), the first bolt 230 does not engage the barrel nut 210, and there is no need for, e.g., a second groove in the barrel nut 210 to receive the first bolt 230. Thus, while the barrel nut 210 may include one or more grooves in addition to the groove 222, such additional grooves are optional.

Because the connecting element 198 connects the first nut portion 186 and the second nut portion 188, torque applied to the second bolt 232 directly or indirectly from the barrel nut 210 is partially distributed to the first bolt 230 and thereby the handguard 102 via the first bolt 230's contact with the first bolt groove 236 in the bottom of the handguard 102. Conversely, torque applied to the first bolt 230 via, e.g., the handguard 102 is distributed to the second bolt 232 and the barrel nut 210, and thereby to the upper receiver 104 (FIG. 1). The reciprocating torque distributions just described provide for a strong and secure coupling amongst the handguard 102, the upper receiver 104 (FIG. 1) and the barrel nut 210, decreasing the components' vulnerability to breakage and/or undesirable disengagement.

Figure 9:
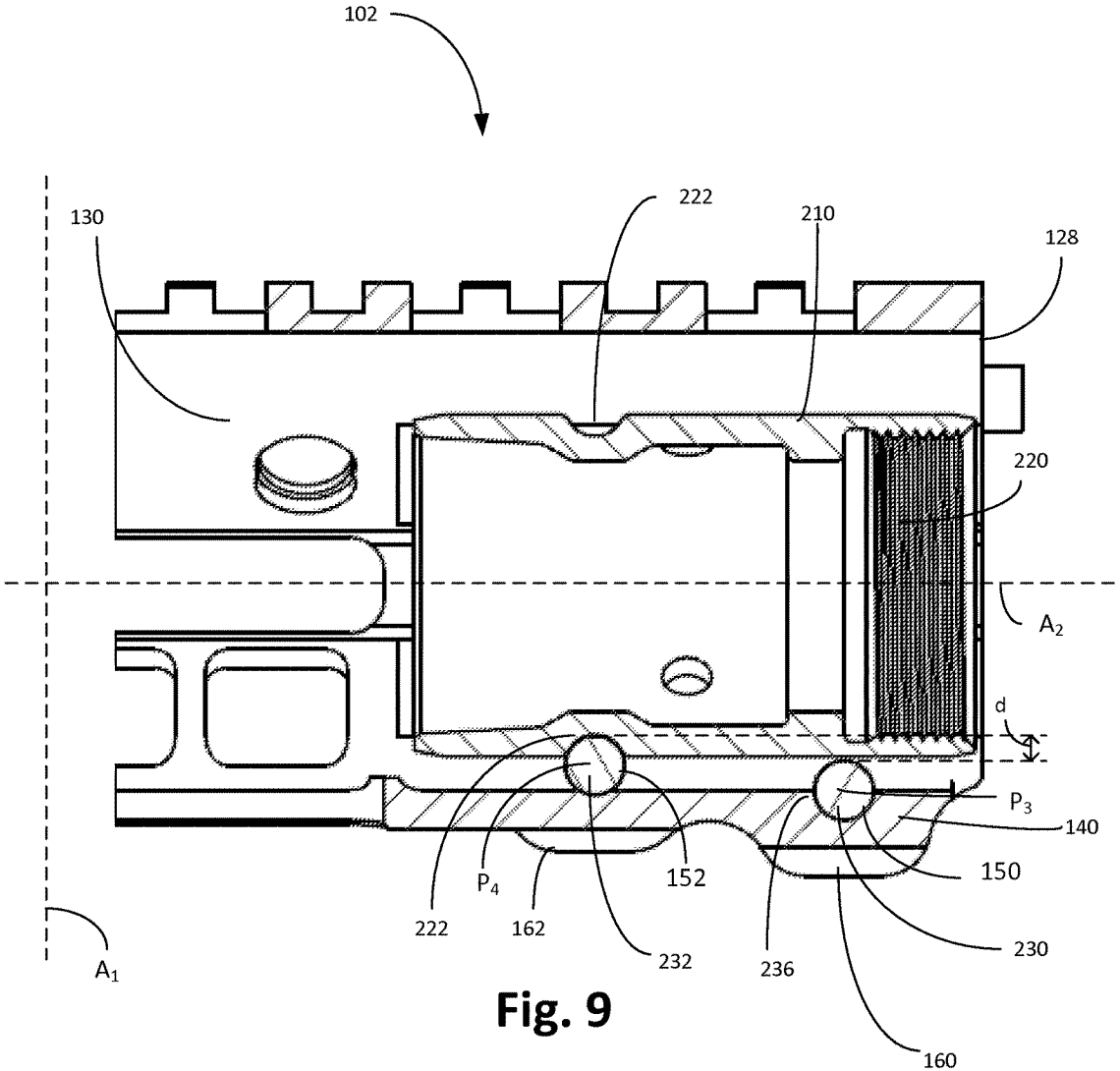
FIG. 9 is a cross-sectional view of a portion of the handguard of FIG. 1 along the line A-A in FIG. 8.
Figure 8:
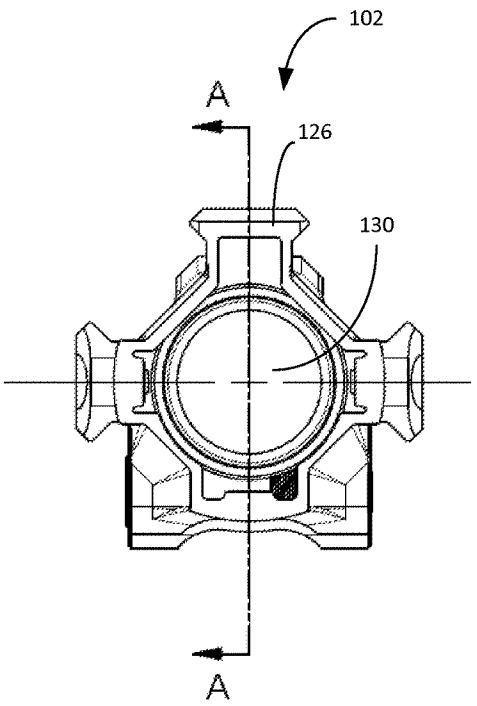
FIG. 8 is a front view of the handguard of FIG. 1.

FIG. 8 is a front view of the handguard 102 of FIG. 1. FIG. 9 is a cross-sectional view of a portion of the handguard 102 of FIG. 1 along the line A-A in FIG. 8. With reference to FIG. 8, the handguard 102 includes the front end 126 and the longitudinal bore 130 as discussed above. With reference to FIG. 9, the handguard 102 includes the back end 128, the longitudinal bore 130, the firearm coupling portion 140, the first tier 160, the second tier 162 and the first bolt groove 236 as discussed above. In addition the barrel nut 210 of FIG. 5 is shown in FIG. 9, having the screw threads 220 and the groove 222 as discussed above. Also shown are the first bolt 230 and the second bolt 232 as discussed above, the second bolt 232 partially disposed within the groove 222, and the first bolt 230 partially disposed within the first bolt groove 236.

With reference to FIG. 9, the center points $P_3$ and $P_4$, respectively, of the first bolt 230 and the second bolt 232 are offset from each other by a distance d. That is, the second bolt 232 is offset from the first bolt 230 by a distance d along the vertical axis $A_1$, $A_1$ being perpendicular to the longitudinal axis $A_2$ of the handguard 102, as shown in FIG. 9. In the example shown in FIG. 9, the second bolt 232 is closer to the longitudinal axis $A_2$, and closer to the top 127 of the handguard 102, than the first coupler receiver 150. The distance d also corresponds to the vertical offset between the first coupler receiver 150 and the second coupler receiver 152, as described above with reference to FIG. 2. In some examples, the distance d is in a range from about 1 mm to about 5 mm. In a particular example, the distance d is about 2.5 mm. In some examples, d falls outside of these values.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A handguard for a firearm comprising:

an elongate member comprising a bore defining a longitudinal axis of the handguard;

a firearm coupling portion;

a first coupler receiver disposed in the firearm coupling portion, the first coupler receiver comprising a first through hole and a second through hole;

a second coupler receiver disposed in the firearm coupling portion, the first and second coupler receivers being configured to receive fasteners to secure the handguard to the firearm, and the second coupler receiver being closer to the longitudinal axis of the handguard than the first coupler receiver;

a groove in a bottom interior surface of the handguard, wherein a portion of the groove aligns with the first coupler receiver and extends laterally between the first through hole and the second through hole;

a first bolt disposed in the first coupler receiver; and a second bolt disposed in the second coupler receiver;

wherein the first bolt engages the groove in the bottom interior surface of the handguard, and the second bolt can engage a groove in a barrel nut disposed in the bore of the handguard.

2. The handguard of claim 1, wherein only one of the first bolt and the second bolt engages a groove in a barrel nut, the barrel nut being disposed in the bore of the handguard.

3. The handguard of claim 1, wherein the elongate member has a front end and a back end, and wherein the groove in the barrel nut is closer to the front end of the elongate member than the groove in the bottom interior surface of the handguard when the handguard is secured to the firearm.

4. The handguard of claim 1, wherein the firearm coupling portion further comprises a recess and a press nut, the recess being configured to receive the press nut for securing the fasteners to the handguard.

5. The handguard of claim 4, wherein the press nut comprises a first nut portion, a second nut portion, a first through hole disposed in the first nut portion, a second through hole disposed in the second nut portion, a connecting element connecting the first nut portion and the second nut portion, and wherein the first through hole is closer to the longitudinal axis of the handguard than the second through hole.

6. The handguard of claim 5, wherein the first through hole receives a first bolt and the second through hole receives a second bolt, wherein the first bolt engages a groove in a bottom interior surface of the handguard, and wherein the second bolt engages a groove in a barrel nut, the barrel nut being disposed in the bore of the handguard.

7. The handguard of claim 6, wherein only one of the first bolt and the second bolt engages a groove in the barrel nut.

8. The handguard of claim 6, wherein the elongate member comprises a front end and a back end, and wherein the groove in the barrel nut is closer to the front end of the elongate member than the groove in the bottom interior surface of the handguard when the handguard is secured to the firearm.

9. A firearm comprising:

a receiver;

a barrel nut;

a free-floating handguard coupled to the receiver with the barrel nut, the handguard comprising a top, a bottom, a firearm coupling portion, a first coupler receiver disposed in a first tier of the firearm coupling portion and a second coupler receiver disposed in a second tier of the firearm coupling portion, the first tier extending lower than the second tier, the first and second coupler receivers being configured to receive fasteners to secure the handguard to the firearm, and the second coupler receiver being higher than the first coupler receiver;

a first bolt disposed in the first coupler receiver; and a second bolt disposed in the second coupler receiver;

wherein the first coupler receiver comprises a first through hole and a second through hole; and the handguard comprises a groove in a bottom interior surface of the handguard, wherein a portion of the groove aligns with the first coupler receiver and extends laterally between the first through hole and the second through hole; and wherein the first bolt engages the groove in the bottom interior surface of the handguard, and the second bolt engages a groove in the barrel nut, the barrel nut being disposed in a longitudinal bore of the handguard.

10. The firearm of claim 9 wherein the second bolt is higher than the first bolt.

11. The firearm of claim 9, wherein the firearm coupling portion further comprises a recess and a press nut, the recess being configured to receive the press nut for securing the fasteners to the handguard.

12. The firearm of claim 11, wherein the press nut comprises a first nut portion, a second nut portion, a first through hole disposed in the first nut portion, a second through hole disposed in the second nut portion, a connecting element connecting the first nut portion and the second nut portion, and wherein the first through hole is lower than the second through hole.

13. The firearm of claim 12, wherein the first through hole disposed in the first nut portion receives a first bolt and the second through hole disposed in the second nut portion receives a second bolt, wherein the first bolt engages the groove in the bottom interior surface of the handguard, and wherein the second bolt engages a groove in the barrel nut, the barrel nut being disposed in a longitudinal bore of the handguard.

14. The firearm of claim 13, wherein only one of the first bolt and the second bolt engages a groove in the barrel nut.

15. The firearm of claim 10 further comprising a front end and a back end, and wherein the groove in the barrel nut is in front of the groove in the bottom interior surface of the handguard.

16. A firearm comprising:

a receiver;

a barrel nut; and a free-floating handguard coupled to the receiver with the barrel nut, the handguard comprising a top, a bottom, a firearm coupling portion, a first hole disposed in a first tier of the firearm coupling portion, a first bolt disposed in the first hole, a second hole disposed in a second tier of the firearm coupling portion, and a second bolt disposed in the second hole, the first tier extending lower than the second tier;

wherein the first bolt engages a groove in a bottom interior surface of the handguard, wherein a portion of the groove aligns with the first hole;

wherein the second bolt engages a groove in the barrel nut, the barrel nut being disposed in a longitudinal bore of the handguard; and wherein the first bolt is lower than the second bolt.

* * * * *